US005701564A

United States Patent [19]

Parker

[11] Patent Number: 5,701,564

[45] Date of Patent: Dec. 23, 1997

[54] SCAVENGELESS DEVELOPMENT APPARATUS INCLUDING AN ELECTRODED DONOR ROLL HAVING A TRI-CONTACT COMMUTATOR ASSEMBLY

[75] Inventor: Delmer G. Parker, Rochester, N.Y.

[73] Assignee: Xerox Corporation, Stamford, Conn.

[21] Appl. No.: 721,303

[22] Filed: Sep. 26, 1996

[51] Int. Cl.[6] ..... G03G 15/08

[52] U.S. Cl. ..... 399/285; 399/90

[58] Field of Search ..... 399/279, 281, 399/285, 286, 90, 266

[56] References Cited

U.S. PATENT DOCUMENTS

| | | | |
|---|---|---|---|
| 3,996,892 | 12/1976 | Parker et al. . | |
| 4,647,179 | 3/1987 | Schmidlin | 399/285 |
| 5,172,170 | 12/1992 | Hays et al. . | |
| 5,394,225 | 2/1995 | Parker | 399/291 |
| 5,473,414 | 12/1995 | Thompson | 399/354 |
| 5,517,287 | 5/1996 | Rodriguez et al. | 399/285 |
| 5,594,534 | 1/1997 | Genovese | 399/285 |

*Primary Examiner*—Matthew S. Smith
*Attorney, Agent, or Firm*—Tallam I. Nguti

[57] ABSTRACT

An electroded donor roll development unit including an electroded donor roll assembly for mounting partially within a mixing chamber of a housing of the development unit for forming a development nip with an image bearing member, and for moving charged toner particles from the mixing chamber to the development nip. The electroded donor roll assembly includes a donor roll having a dielectric layer, and axially extending electrodes formed in the surface of the dielectric layer. The donor roll assembly also includes a bias voltage source for biasing the electrodes and a tri-contact commutator or assembly mounted on the donor roll and connected to the bias voltage source for commutating a bias voltage to the electrodes while significantly reducing and eliminating risk of sporadic electrical arcing during bias commutation. The tri-contact commutator assembly includes a disc forming a circular flange at one end of the donor roll, a series of commutator contact pads connected to the electrodes on the donor roll and having relatively large fanned out spacings between adjacent contact pads. Importantly, the tri-contact commutator assembly includes a plurality of commutating members, connected to the bias voltage source for commutating a bias voltage to the commutator contact pads. The plurality of commutating members include first and second high resistivity members that are spaced from each other circumferentially relative to the circular flange, and a low resistivity, third member spaced from the high resistivity first and second members in a radial direction relative to the circular flange, so as to enable effective commutation of the bias voltage without significant risk of sporadic electrical arcing.

10 Claims, 5 Drawing Sheets

SCAVENGELESS DEVELOPMENT APPARATUS INCLUDING AN ELECTRODED DONOR ROLL HAVING A TRI-CONTACT COMMUTATOR ASSEMBLY

BACKGROUND

This invention relates generally to electrostatographic reproduction machines, and more particularly concerns a scavengeless development apparatus including an electroded donor roll having a tri-contact commutator assembly for significantly reducing and eliminating undesirable electrical arcing during commutation of a bias voltage to electrodes of the donor roll.

Generally, the process of electrostatographic reproduction includes uniformly charging a photoconductive member, or photoreceptor, to a substantially uniform potential, and imagewise discharging it or exposing it to light reflected from an original image of a document being reproduced. The result is an electrostatically formed latent image on the photoconductive member. The latent image is then developed by bringing a charged developer material into contact therewith. Two-component and single-component developer materials are commonly used. A typical two-component developer material comprises magnetic carrier particles, also known as "carrier beads," having charged toner particles adhering triboelectrically thereto. A single component developer material typically comprises charged toner particles only. In either case, the charged toner particles when brought into contact with the latent image, are attracted to such image, thus forming a toner particles image on the photoconductive member. The toner particles image is subsequently transferred to a receiver sheet which is then passed through a fuser apparatus where the toner particles image is heated and permanently fused to the sheet forming a copy of the original image.

In electrostatographic reproduction machines for making copies of highlight or full-color images, latent images of color components thereof are formed as above on a photoreceptor, and developed using a suitable development technique with different color toner particles.

As disclosed for example in the following references, one such development technique is referred to as scavengeless development in which a plurality of electrode wires are closely spaced relative to a donor roll, and an AC bias voltage is applied in a development nip to the electrode wires for forming a toner cloud of toner particles on the donor roll.

For example, in U.S. Pat. No. 5,172,170, assigned to the assignee of the present application, a scavengeless development apparatus is disclosed in which a set of longitudinally-disposed electrodes are mounted on or embedded in a rotating donor roll.

In U.S. Pat. No. 3,996,892 ('892 patent) granted to Parker et al. on Dec. 14, 1976 a spatially programmable electroded donor roll is disclosed wherein a DC voltage is applied to the wire electrodes in the development nip or zone, pre-nip and post-nip zones through commutating brushes at the ends of the donor roll.

The '892 patent, in a second embodiment, discloses the use of a ring-like resistive member mounted for rotation with a donor roll. A plurality of stationarily mounted electrical contacts ride on the ring-like member which, in turn, is seated on the coating free portions of conductors and mounted for rotation with a sleeve upon which the conductors are carried.

In U.S. Pat. No. 5,394,225 ('225 patent) issued Feb. 28, 1995 to Parker, and commonly assigned, a non-interactive or scavengeless development system is disclosed for use in color imaging. To control the developability of lines and the degree of interaction between the toner and receiver, an AC voltage is applied between a donor roll and two sets of interdigitated electrodes embedded in the surface of the donor roll to enable efficient detachment of toner from the donor to form a toner cloud. An optical switching arrangement effects an electrical connection between a slip ring and one set of interdigitated electrodes In the '225 patent, to minimize wear and tear on the embedded electrodes one set of the interdigitated wire electrodes makes contact with a continuous slip ring at one end of the donor roll. The other set of electrodes is electrically connected to the source of power through a commutator member which makes rolling contact with the electrodes thereof.

In each scavengeless electroded development (SED) apparatus as disclosed for example above, one common disadvantage encountered is sporadic electrical arcing of the electrodes during bias voltage commutation. Generally, devising a reliable structure for commutating a 3 Khz, bias voltage of about 1,300 volts to delicate electrodes embedded on the SED roll, is a difficult task. During such commutation, there is always the potential and significant risk for sporadic arcing that can permanently damage the delicate electrodes.

Conventionally, such commutation typically is performed with a single soft carbon fiber brush. As a protective measure against such sporadic arcing attempts have been made to tailor the resistivity profile of these brushes side to side in the commutating direction so that the lowest resistance fibers are in the center, and so that more resistive fibers are on either side thereof where the brush first makes, or breaks contact with a passing electrode. The purpose of this is to have a higher resistance along the fiber path where an arc is most likely to be initiated. However, because of the difficulty of precisely demarking a transition point between low and high resistance fibers of a brush, and because of the close spacing between electrodes devising a design with realistic tolerances has been a problem. Enabling the bias supply only when the brush is in good contact with the electrode has also been suggested as a way to minimize such arcing, but this approach requires that the high voltage bias supply output be synchronized with the electrode's precise position and thus is difficult to achieve.

There is therefore a need for an electrical donor roll development unit including an electroded donor roll assembly having a commutation assembly capable of significantly and reliably reducing and eliminating undesirable risk of sporadic electrical arcing during bias commutation.

SUMMARY OF THE INVENTION

In accordance with one aspect of the present invention, there is provided an electroded donor roll development unit including an electroded donor roll assembly for mounting partially within a mixing chamber of a development unit for forming a development nip with an image bearing member, and for moving charged toner particles from the mixing chamber to the development nip. The electroded donor roll assembly includes a donor roll having a dielectric layer, and axially extending electrodes formed in the surface of the dielectric layer. The donor roll assembly also includes a bias voltage source for biasing the electrodes and a tri-contact commutator or assembly mounted on the donor roll and connected to the bias voltage source for commutating a bias voltage to the electrodes while significantly reducing and eliminating risk of sporadic electrical arcing during bias commutation. The tri-contact commutator assembly includes a disc forming a circular flange at one end of the donor roll, a series of commutator contact pads connected to the electrodes on the donor roll and having relatively large fanned out spacings between adjacent contact pads. Importantly, the tri-contact commutator assembly includes a plurality of commutating members, connected to the bias voltage source for commutating a bias voltage to the commutator contact pads. The plurality of commutating members include first and second high resistivity members that are spaced from each other circumferentially relative to the circular flange, and a low resistivity, third member spaced from the high resistivity first and second members in a radial direction relative to the circular flange, so as to enable effective commutation of the bias voltage without significant risk of sporadic electrical arcing.

BRIEF DESCRIPTION OF THE DRAWINGS

Other features of the present invention will become apparent as the following description precedes and upon reference to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 6 printing machine will be shown hereinafter only schematically and their operation described only briefly with reference thereto.

Figure 6:
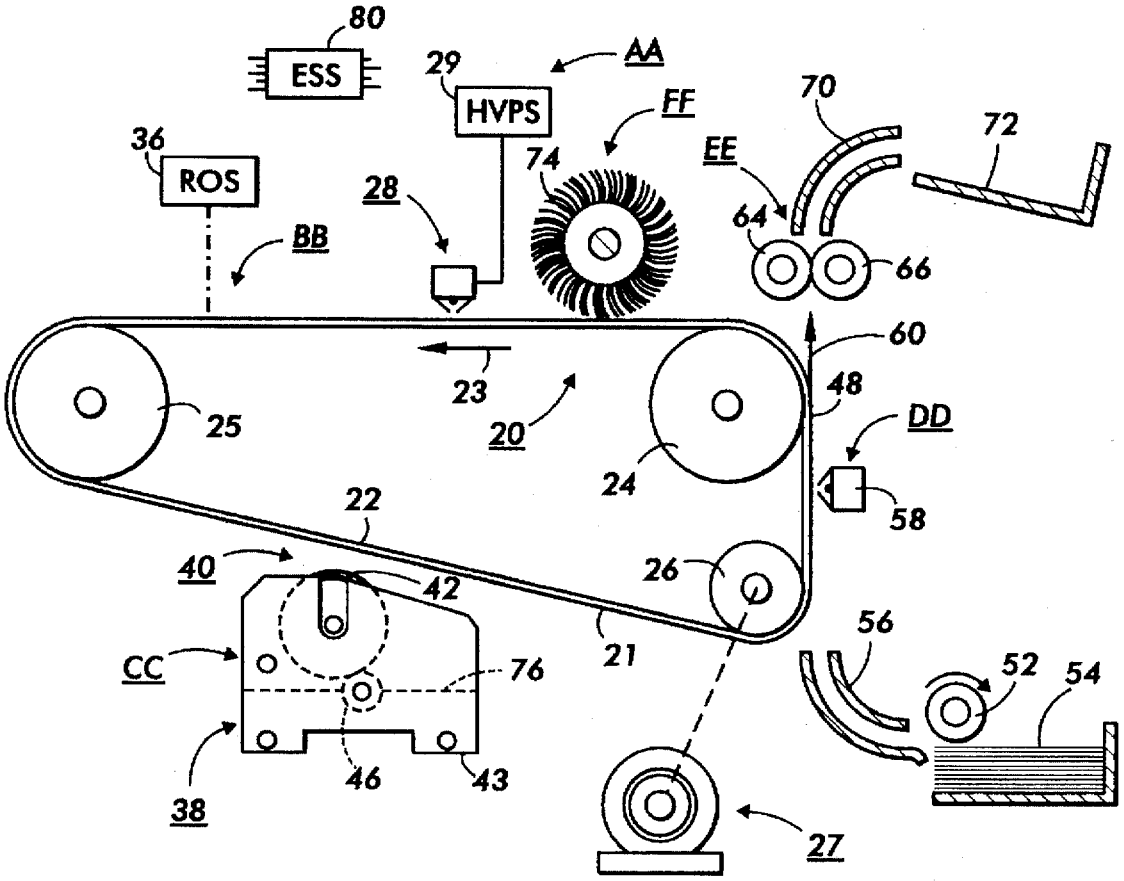
FIG. 6 is a schematic elevational view of an illustrative electrostatographic reproduction machine incorporating the development apparatus of the present invention.

Referring initially to FIG. 6, there is shown an illustrative electrophotographic reproduction machine incorporating the scavengeless electroded (SED) development apparatus or unit of the present invention. The reproduction machine incorporates a photoreceptor 20 in the form of a belt having a photoconductive surface layer 21 on an electroconductive substrate 22. Preferably the surface 21 is made from a selenium alloy. The substrate 22 is preferably made from a conductive material which is electrically grounded. The belt is driven by means of motor 27 along a path defined by rollers 24, 25 and 26, the direction of movement being counter-clockwise as viewed and as shown by arrow 23.

Initially a portion of the belt 20 passes through a charge station AA at which a corona generator 28 charges surface 21 to a relatively high, substantially uniform, potential. A high voltage power supply 29 is coupled to device 28.

Next, the charged portion of photoconductive surface 21 is advanced through exposure station BB. At exposure station BB, a ROS (raster output scanner) 36 lays out the image in a series of horizontal scan lines with each line having a specified number of pixels per inch. The ROS 36 includes a laser having a rotating polygon mirror block associated therewith. The ROS exposes the charged photoconductive surface of the reproduction machine.

After the electrostatic latent image has been recorded on photoconductive surface 21, belt 20 advances the latent image to development station CC where a development unit 38 (such as the scavengeless electroded development unit of the present invention, to be described in detail below), develops the latent image recorded on the photoconductive surface.

Still referring to FIG. 6, after the electrostatic latent image has been developed, belt 20 advances the developed image to transfer station DD, at which a copy sheet 54 is advanced by roll 52 and guides 56 into contact with the developed image on belt 20. A corona generator 58 is used to spray ions onto the back of the sheet so as to attract the toner image from belt 20 to the sheet. As the belt turns around roller 24, the sheet is stripped therefrom with the toner image thereon.

After transfer, the sheet is advanced by a conveyor (not shown) to fusing station EE. Fusing station EE includes a heated fuser roller 64 and a back-up roller 66. The sheet passes between fuser roller 64 and back-up roller 66 with the toner powder image contacting fuser roller 64. In this way, the toner powder image is fused and permanently affixed to the sheet. After fusing, the sheet advances through chute 70 to catch tray 72 for subsequent removal from the reproduction machine by an operator.

In the process as described above, after the sheet is separated from photoconductive surface 21 of belt 20, residual toner particles adhering to photoconductive surface 21 are removed therefrom at cleaning station FF for example by a rotatably mounted fibrous brush 74 in contact with photoconductive surface 21. Subsequent to cleaning, a discharge lamp (not shown) floods photoconductive surface 21 with light to dissipate any residual electrostatic charge remaining thereon prior to the charging thereof for the next successive imaging cycle.

As is well known, the reproduction machine may include an electronic control subsystem or ESS 80 for controlling the various components and operating subsystems of the machine. ESS 80, for example, may be a self-contained dedicated minicomputer. As such, it may include at least one, and may be several programmable microprocessors for handling all control data including control signals from sensors for the various controllable aspects of the machine.

It is believed that the foregoing description is sufficient for purposes of the present application to illustrate the general operation of an electrophotographic reproduction machine incorporating the development apparatus of the present invention.

Figure 1:
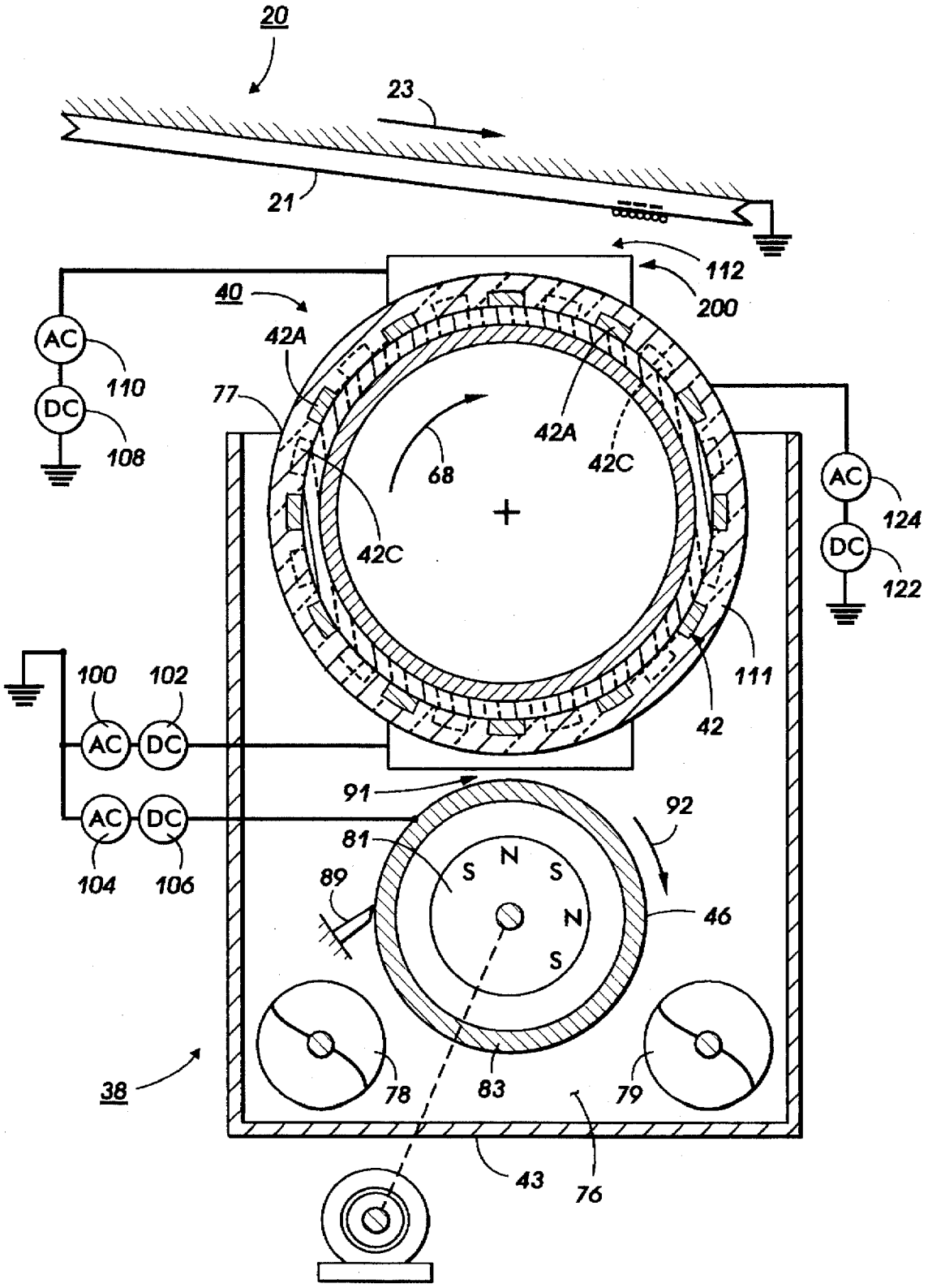
FIG. 1 is a schematic elevational view of a development unit incorporating a donor roll assembly according to the present invention.
Figure 2:
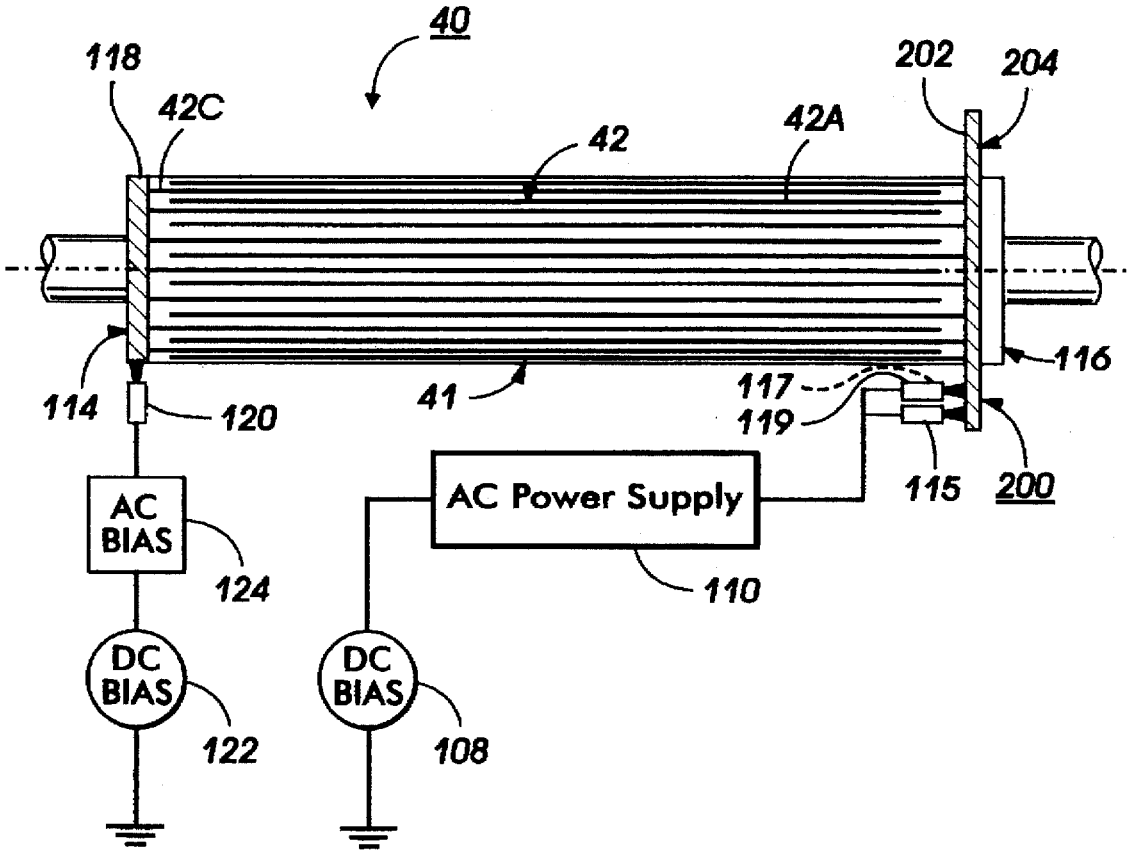
FIG. 2 is a schematic illustration of the donor roll assembly of FIG. 1 including the tri-contact commutator assembly of the present invention.

Referring now to FIGS. 1 and 2, there is shown the development unit 38 and a donor roll assembly 40 of the present invention in greater detail. Development unit 38 includes a housing 43 defining a developer sump or chamber 76 for storing a supply of developer material consisting of magnetic carrier particles and charged toner particles. As shown, the housing 43 further defines an opening 77 for positioning facing the image bearing surface 21 of image bearing member 20.

The donor roll assembly 40 of the present invention includes biasable electrodes 42, as are well known, and is rotatable in the direction, for example, of the arrow 68. Donor roll assembly 40 is mounted within the opening 77 of housing 43, and partially within the chamber 76, such that it forms a development zone or nip 112 with the surface 21 of the image bearing 20. When rotated in the direction of the arrow 68, for example, donor roll assembly 40 operates to move charged toner particles transfered to it into the nip 112 for developing a latent image on the surface 21.

The development system 38 also includes a pair of horizontal mixing augers shown as 78, 79 that are mounted within the chamber 76 for mixing developer material within the chamber, and a magnetic transport roll 46 for transporting developer material into a toner particle transfer relationship with the donor roll assembly 40.

Magnetic transport roll 46, as shown, may include a stationary multi-pole magnet 81 having a closely spaced sleeve 83 of non-magnetic material designed to be rotated about the magnet 81 in a direction indicated by arrow 92. When rotated as such, transport roll 46 moves with it, a quantity of mixed developer material containing magnetic carrier particles and charged toner particles adhering thereto. A doctor blade 89, as shown, is mounted for metering the quantity of developer material being moved by the sleeve 83 as it rotates to a loading zone or nip 91, formed by the transport roller 46 and donor roll assembly 40.

As further shown, an alternating voltage source 100 and a constant voltage source 102 are provided for electrically biasing donor roll assembly 40 in the toner loading zone or nip 91. Magnetic transport roller 46 is similarly electrically biased by an AC voltage source 104 and a DC voltage source 106 within the loading zone 91. The relative voltages between donor roll assembly 40 and magnetic roller 46 are selected so as to provide efficient loading or transfer of toner particles from devleoper material on magnetic roller 46 onto donor roll assembly 40. Furthermore, reloading of developer material onto roller 46 is also enhanced by such biasing.

In the development zone or nip 112 formed by the donor roll assembly 40 and the latent image bearing photoconductor 20 moving in the direction of arrow 23, bias voltage sources 108 and 110, as well as 122, 124 electrically bias the electrical conductors or electrodes 42 to a DC voltage and an AC voltage superimposed thereon, as shown. Voltage sources 108 and 110 are connected to one set of electrodes, active electrodes 42A, and the sources 122, 124, as shown, are connected to another set of electrodes, common electrodes 42C, of the tri-contact commutator assembly 200 of the present invention (to be described in detail below).

Referring in particular to FIG. 2, the donor roll assembly 40, as shown, includes a donor roll 41 and the electrodes 42 in the form of electrical conductors formed on the peripheral circumferential surface of donor roll 41. The electrodes 42, for example, are copper strips that may be formed by any suitable process such as by photo etching, plating, overcoating or silk screening. As shown, the electrodes 42 are substantially spaced one from another, and are insulated from the body of donor roll 41, which itself may be slightly electrically conductive.

The electrodes 42 preferably include two sets, as shown, consisting of common electrodes 42C, and active electrodes 42A which are interdigitized or spaced between the common electrodes 42C. The interdigitated electrodes are each about 4 mill wide, and are spaced about 0.006 mil apart around the periphery of the donor roll 41. Half (active electrodes shown as 42A) of the about 300 electrodes 42, formed around the circumference of a 2.5 cm diameter donor roll for example, are commutatable within the development nip 112, while the other half (common electrodes shown as 42C) are connected to a common return. Commutation is made somewhat easier if two or three of the active electrodes 42A are joined together at their ends, and are commutatable in parallel.

As shown, the common electrodes 42C extend outwardly from a first end 114 of the donor roll 41, and the active electrodes 42A extend outwardly from a second end 116 of the donor roll 41. The common electrodes 42C are electrically connected together at the first end 114, and the active electrodes 42A are electrically connected, singly or together into small groups of 1 to 4 electrodes, at the second end 116 of the donor roll 41.

The donor roll 41, or at least a layer 111 thereof, is preferably of a material which has sufficient electrical conductivity so as to assist in preventing any long term build up of electrical charge. The conductivity of the layer 111 however should be sufficiently low so as to form a blocking layer to prevent shorting of magnetic developer material transported passed the donor roll by the transport roller 46. Based on the biasing scheme of the sources 108, 110, 122 and 124, there is an AC potential difference maintained between active electrodes 42A and the common electrodes 42C when the common electrodes pass through the development nip 112. The conductivity of layer 111 is also chosen so as to be sufficiently low in order to avoid too high a current draw between electrodes.

The donor roll assembly 40 also includes a slip ring 118 mounted at a first end 114 of the donor roll 41, and a conventional commutating contact member, such as a brush 120 in contact with the slip ring 118. As shown, the commutating contact brush 120 is connected to the development bias sources 122, 124.

Referring now to FIGS. 2 to 5, donor roll assembly 40 importantly includes the tri-contact commutator assembly 200 (FIGS. 3 and 4) of the present invention. As shown, the tri-contact commutator assembly 200 includes a flange 202 that is formed by a disc 204 having a desired radius and mounted at the second end 116 of the donor roll 41. The disc 204 and hence flange 202, can be formed out of a single, or double sided foil printed circuit board, such as a G10 board on which commutator contact pads 42P are created by conventional printed circuit board etching techniques or by laser ablation. Disc 204 can then be keyed and amalgamated with the donor roll 41, and the commutator contact pads joined or hard wired by soldering or wire bonding techniques to their corresponding active electrodes 42A. The disc 204 as such, can then be mechanically reinforced with a hub (not shown) that slides over the end of the donor roll 41.

In accordance with the present invention, the tri-contact commutator assembly 200 also includes a plurality of commutating members 115, 117 and 119 that are each electrically connected to voltage sources 108 and 110, and are mounted for contacting the active electrodes 42A when these electrodes are moved on the surface of the donor roll 41 into the development zone or nip 112. As shown, the plurality of commutating members are mounted so as to contact the isolated contact pads of the active electrodes 42A on the flange 202, for biasing the active electrodes within the development nip 112 without a significant risk of undesirable sporadic electrical arcing.

The tri-contact commutating members 115, 117, 119 consist of two high resistance members 117, 119 and of a low resistance, highly conductive member 115. Preferably, each of the commutating members 117, 119 and 115 consists of a conductive fiber brush, such as an electrically conductive, carbon impregnated plastic brush having fibers. Preferably, individual fibers of each brush 115, 117 and 119 can be electrically isolated from one another, and the resistance of each can be selected.

Figure 4:
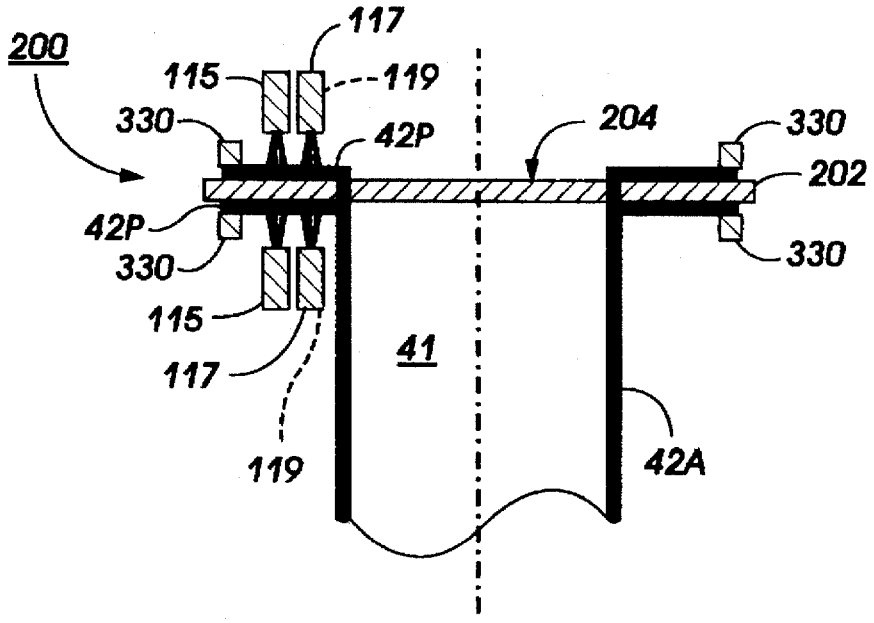
FIG. 4 is a schematic of a two-sided embodiment of the tri-contact commutator assembly of FIG. 3.

FIG. 2, shows one embodiment of the tri-contact commutator assembly of the present invention having only one set of the plurality of commutating members 115, 117, 119 located to one surface of the flange 202. FIG. 4 shows a second embodiment having two sets of the plurality of commutating members 115, 117, 119 located to both sides or surfaces of the flange 202, thus enabling a further and more robust increase in the spatial separation or spacing between commutator contact pads on each side or surface.

Figure 5:
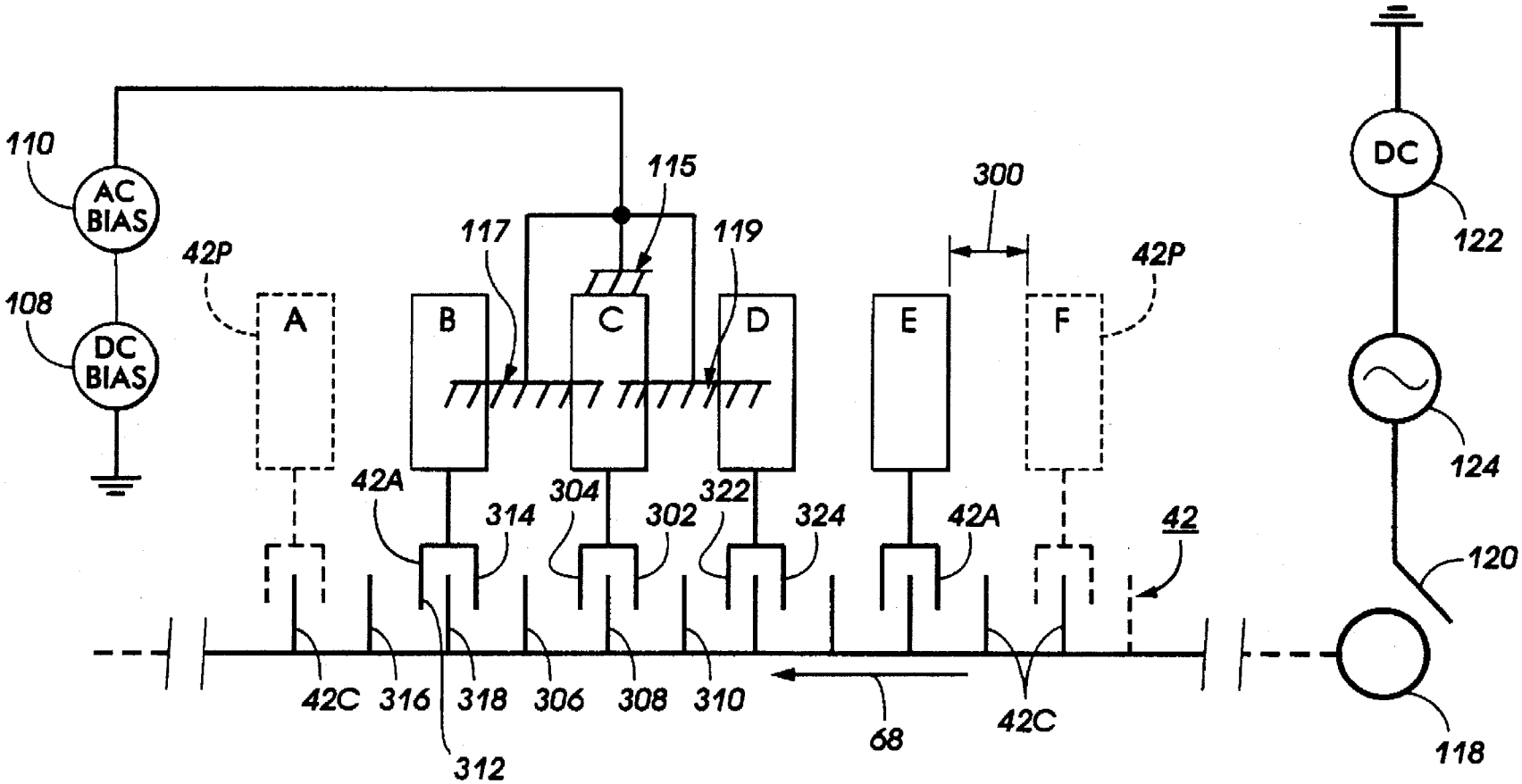
FIG. 5 is a detailed illustration of the operation of the tri-contact commutator assembly of the present invention.

Referring in particular to FIG. 5, the tri-contact commutator assembly includes the flange 202, (one side of which is illustrated in FIG. 5), and a series of commutator contact pads 42P that are formed on the surface of the flange. As shown, each commutator contact pad is permanently connected or wired to one, or more of the active electrodes 42A. As shown, a set of the series of commutator contact pads 42P is illustrated, for example, as A', B', C', D', E' and F'. Each pad of the series of pads A', B', C', D', E' and F' for example is connected to two active electrodes 42A. Note that individual active electrodes 42A are interleaved with adjacent common electrodes 42C. The common electrodes 42C are connected to the sources 122, 124, or alternatively (not shown) they can be connected to the return of the bias power supplies 108, 110 through the brush 120, and slip ring 118. As the donor roll 41 is rotated, the commutator contact pads 42P, for example, the set A', B', C', D', E', and F' are each rotated into sequential biasing contact with commutating members 119, 115, and 117.

Figure 3:
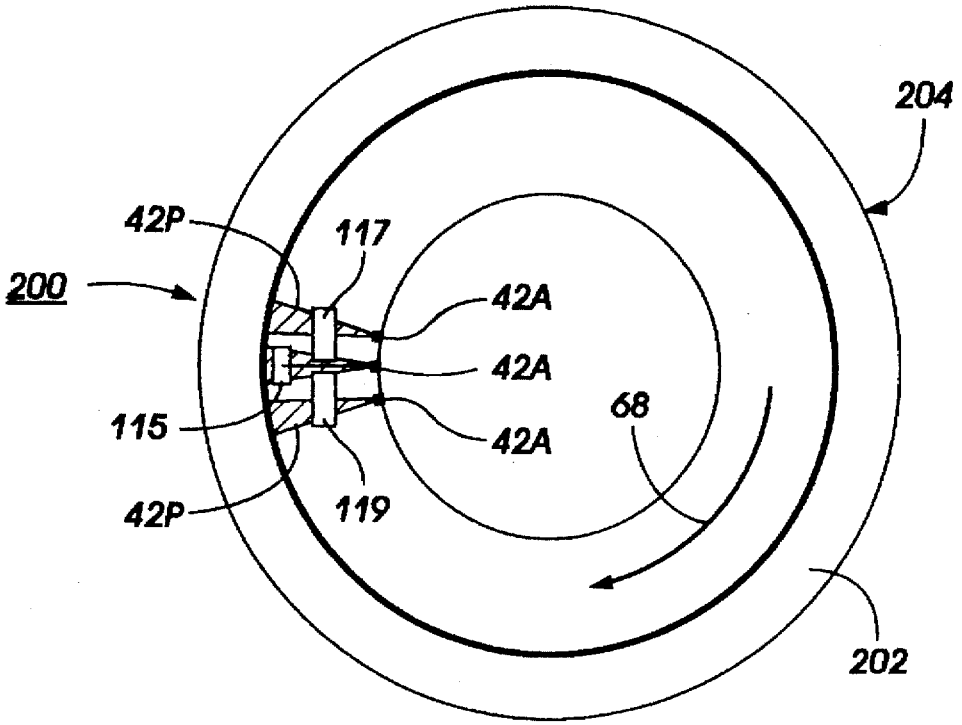
FIG. 3 is an enlarged schematic of one side of the disc forming the flange of the donor roll assembly of FIG. 2, and showing the arrangement of the plurality of commutating members of the present invention.

As illustrated more clearly in FIGS. 3 and 5, the tri-contact commutating members or brushes 115, 117 and 119 are mounted such that the high resistivity members or brushes 119 and 117 are mounted spaced circumferentially relative to the circular flange 202. Mounted as such, these high resistance or resistivity members 117, 119 sequentially contact commutator contact pads 42P as such pads move with the flange 202 in the direction of the arrow 68. As shown, these two members 117 and 119 are preferably spaced an equal distance radially relative to the flange 202. However, as further shown, the third, low resistivity, highly conductive member or brush 115 is spaced in a radial direction relative to the flange 202, from the first two members 117 and 119, and is located at a position centered circumferentially (relative to the flange 202) between the first two members 117 and 119.

In FIG. 5, the low resistance, highly conductive commutating member or brush 115 is shown at an instant, for example, when it is making contact with a commutator pad C', thus causing the active electrodes shown as 302, 304 attached to the commutator pad C', to be at the same potential as the bias supply sources 108, 110. Preferably, the width dimension (as illustrated) of the member or brush 115 is such as to be less than a typical spacing 300 between adjacent commutator contact pads 42P. As such, the member or brush 115 will make contact with only one contact pad 42P at a time, as the pads are moved pass the commutating members.

The first, high resistance member or brush 117 is made wider than the low resistivity member or brush 115. Preferably, the member or brush 117 is advantageously wide enough to completely span and contact each commutator contact pad 42P (for example pad C') that is in contact with the low resistance member or brush 115, and still wide enough to the overlap such pad C' and contact the adjacent pad downstream, such as the pad B'. Note that the pad B' is a pad that has most recently been in contact with the member or brush 115. This arrangement insures that at the instant when electrical contact is broken between the member or brush 115 and the pad C', charge stored across an inter-electrode capacitance between the active electrodes 302, 304 attached to pad C' and their adjacent common electrodes 306, 308, 310 can be discharged to the bias supply source 108, 110 through the high resistance fibers of member or brush 117.

More precisely, the instantaneous potential of the active electrodes 312, 314 attached to pad B' will be at a voltage determined by the voltage division of the applied AC bias 110 potential across the resistance of the fibers of brush 117 in series with the inter-electrode capacitive reactance of the active electrodes 312, 314 and the adjacent common electrodes 316, 318, and 306.

Furthermore, where the member 117 is a brush as preferred, individual fibers in brush 117 can be electrically isolated from one another, and the resistance of each can be selected so that resistance increases as the distance away from member or brush 115 increases. Thus, the spatial voltage profile of the voltage on pad B' can be tailored so that it is damped to any arbitrarily chosen low value as it moves away from the member or brush 115.

Likewise, the second high resistivity member or brush 119 is constructed in the same manner as member or brush 117, and performs relative to upstream pads, such as the D' as such pad approaches the member or brush 115, a similar function to that performed by member or brush 117 relative to pad C'. In this case, the voltage on the active electrodes 322, 324 of the pad D', is increased spatially from some arbitrarily low ambient level to that of the AC bias supply 110 as the pad D' comes into contact with member or brush 119. It is noted that the voltage profile of the approaching and departing electrodes need not necessarily be linear. The members or brushes 119 and 117 are made wide enough so as to be able to each make contact with at least two commutator contact pads, such as pads C' and D' when so desired.

The tri-contact commutator assembly of the present invention is less prone to sporadic electrical arcing, and is achieved by fanning out and significantly separating the commutator contact pads 42P in a radial direction on the circular flange 202. Fanning out the commutator contact pads as such significantly improves the spatial resolution of the commutator contact pads by a factor equal to the ratio of the radius of the disc 204 forming the flange 202, to that of the donor roll. Thus, where the flanged is formed by a disc having a radius twice the size of that of the donor roll, the spatial resolution of the commutator contact pads can be increased by a factor of two. In a second embodiment, the flange 202 is formed using a double-sided printed circuit board. As such, a second alternating set of commutator contact pads 42P can be formed on the second and opposite side of the flange 202, thereby enabling a further increase of the spatial resolution of the commutator contact pads by another factor of two.

The spatial resolution dividend can be taken either in wider commutator contact pads 42P, or as increased electrical isolation spacings 300 between the adjacent contact pads 42P at the commutating position. The greater each spacing 300 or spatial separation 300, the more desirous it is in accordance with the present invention to use a separate, third, low resistivity member or brush 115 positioned centered between a pair of high resistivity members or brushes 117, 119 on either side thereof, for making initial and ending contact with an approaching and an exiting contact pad 42P, and hence their connected active electrode 42A. The resistance of each of the outer members or brushes 117, 119 can be distributed in the fibers thereof, or lumped into a series resistor in the power lead to each such member or brush.

To further guard against sporadic arcing in accordance with the present invention, a set of resistors shown as 330 can be inserted at the periphery of the disc 204 between the commutator contact pads, and hence their connected electrodes. These resistors can be discrete or they can be of the evaporated film type. It has been found that a 10 megohm resistor of the type effective as such between electrodes having a 20 pF interelectrode capacitance, has a time constant of 200 microseconds, which is about the period of a 3 Khz bias voltage. On the other hand, a 1 megohm resistor between the same electrodes has a time constant of 20 microseconds.

As can be seen, there has been provided a scavengeless electroded (SED) development apparatus in accordance with the present invention. The development apparatus includes a donor roll assembly having a donor roll, and a tri-contact commutator assembly for significantly reducing and eliminating the risk of sporadic electrical arcing during commutation, and for enabling more robust commutation. The tri-contact commutator assembly includes a disc forming a flange, and commutator contact pads formed on the flange.

The commutator contact pads of are formed, fanned out radially on one, or both sides of the flange at one end of the donor roll. Such fanning out of the commutator contact pads advantageously enables providing a larger commutating surface and a greater spatial isolation between the electrodes at the point where the commutator contact pads make contact with commutating members, thereby significantly reducing and eliminating the risk of sporadic electrical arcing during commutation, and thereby, enabling a comprises a plurality of commutating members including first and second high resistance members spaced circumferentially on the flange, and a low resistance member centered between, and spaced radially from, the two high resistance members so as to enable significantly reducing and eliminating the risk of sporadic electrical arcing during commutation, and enabling more robust commutation.

What is claimed:

1. A development unit comprising:

(a) a housing defining a mixing chamber storing developer material consisting of magnetic carrier particles and charged toner particles;

(b) an electroded donor roll assembly mounted partially within the mixing chamber for forming a development nip with an image bearing member, and moving charged toner particles through the development nip;

(c) a donor roll assembly including a donor roll having axially extending electrodes formed thereon, said donor roll assembly including a bias voltage source for biasing the electrodes, and a tri-contact commutator assembly mounted thereon and connected to said bias voltage source for commutating a bias voltage to said electrodes while significantly reducing a risk of sporadic electrical arcing; said tri-contact commutator assembly including:

(i) a disc forming a circular flange at one end of said donor roll;

(ii) a series of commutator contact pads formed on said flange and connected to said electrodes; and (iii) a plurality of commutating members, mounted to contact said commutator pads and connected to said bias voltage source for commutating the bias voltage to said electrodes, said plurality of commutating members including (a) a first and a second high resistivity members, said first and said second high resistivity members being spaced from each other circumferentially relative to said circular flange, and (b) a third, low resistivity member spaced from said first and said second high resistivity members in a radial direction relative to the circular flange, so as to enable effective commutation of the bias voltage without significant risk of sporadic electrical arcing.

2. The development unit of claim 1, wherein said plurality of commutating members each comprise a conductive carbon fiber brush.

3. The development unit of claim 1, wherein said commutator contact pads formed on said flange have relatively large fanned out spacings between adjacent contact pads.

4. The development unit of claim 1, wherein said tri-contact commutator assembly includes a first set and a second set of said series of commutator contact pads formed on first and second sides of said flange and connected to electrodes, thereby enabling increases in spacings between adjacent commutator contact on each side of said flange.

5. The development unit of claim 1, wherein said first and said second high resistivity commutating members are each spaced and equal distance radially on said flange.

6. The development unit of claim 1, wherein said low resistivity, third commutating member is positioned centered in a circumferential direction between said first and said second high resistivity commutating members.

7. The development unit of claim 1, wherein said low resistivity, third commutating member has a width dimension, equal to less than that of a typical spacing between adjacent commutator contact pads, for making contact with only one commutator contact pad at a time.

8. The development unit of claim 1, wherein each of said first and said second high resistivity commutating members is wider than said low resistivity member for enabling simultaneous contact with more than one commutator contact pad at a time.

9. In a development unit for developing a latent image formed on an image bearing member, the development unit having a rotatable electroded donor roll assembly including a rotatable donor roll having axially extending electrodes formed thereon, and a tri-contact commutator assembly comprising:

(a) a disc forming a circular flange at one end of the donor roll;

(b) a series of commutator contact pads connected to the electrodes on the donor roll and having relatively large fanned out spacings between adjacent contact pads; and (c) a plurality of commutating members, mounted to contact said commutator contact pads and connected to a bias voltage source for commutating a bias voltage to a commutator contact pads, said plurality of commutating members including a first high resistivity member and a second high resistivity member, said first and said second high resistivity members being spaced from each other circumferentially relative to said cir cular flange, and said plurality of commutating members including a third, low resistivity member spaced from said first and said second high resistivity members in a radial direction relative to the circular flange, so as to enable effective commutation of the bias voltage without significant risk of sporadic electrical arcing.

10. An electrostatographic reproduction machine comprising;

(a) a movable image bearing member having an image bearing surface defining a path of movement;

(b) latent image forming means mounted along said path of movement for forming a latent image on said image bearing surface; and (c) a development unit for developing a latent image formed on an image bearing member, the development unit having a rotatable electroded donor roll assembly including a rotatable donor roll having axially extending electrodes formed thereon, and a tri-contact commutator assembly including:

(i) a disc forming a circular flange at one end of the donor roll;

(ii) a series of commutator contact pads connected to the electrodes on the donor roll and having relatively large fanned out spacings between adjacent contact pads; and (iii) a plurality of commutating members, mounted to contact said commutator contact pads and connected to a bias voltage source for commutating a bias voltage to said commutator contact pads, said plurality of commutating members including a first high resistivity member and a second high resistivity member, said first and said second high resistivity members being spaced from each other circumferentially relative to said circular flange, and said plurality of commutating members including a third, low resistivity member spaced from said first and said second high resistivity members in a radial direction relative to the circular flange, so as to enable effective commutation of the bias voltage without significant risk of sporadic electrical arcing.

* * * * *